US011170953B2

(12) United States Patent
Osaki

(10) Patent No.: US 11,170,953 B2
(45) Date of Patent: Nov. 9, 2021

(54) TRIGGER SWITCH

(71) Applicant: OMRON Corporation, Kyoto (JP)

(72) Inventor: Kazufumi Osaki, Okayama (JP)

(73) Assignee: Omron Corporation, Kyoto (JP)

( * ) Notice: Subject to any disclaimer, the term of this patent is extended or adjusted under 35 U.S.C. 154(b) by 316 days.

(21) Appl. No.: 16/482,783

(22) PCT Filed: Dec. 12, 2017

(86) PCT No.: PCT/JP2017/044589
§ 371 (c)(1),
(2) Date: Aug. 1, 2019

(87) PCT Pub. No.: WO2018/168126
PCT Pub. Date: Sep. 20, 2018

(65) Prior Publication Data

US 2021/0304977 A1 Sep. 30, 2021

(30) Foreign Application Priority Data

Mar. 14, 2017 (JP) ..... JP2017-049048

(51) Int. Cl.
*H01H 13/14* (2006.01)
*H01H 1/14* (2006.01)
(Continued)

(52) U.S. Cl.
CPC ..... *H01H 13/14* (2013.01); *H01H 1/14* (2013.01); *H01H 13/04* (2013.01); *H01H 13/20* (2013.01)

(58) Field of Classification Search
CPC ..... H01H 13/14; H01H 1/14; H01H 13/04; H01H 13/20; H01H 2223/04; H01H 13/08
(Continued)

(56) References Cited

U.S. PATENT DOCUMENTS 6,057,749 A * 5/2000 Doneghue ..... H01H 50/021 335/128
6,749,028 B1 6/2004 Chan et al.
2016/0365202 A1* 12/2016 Koyama ..... B25F 5/00

FOREIGN PATENT DOCUMENTS

JP H02-134621 U 11/1990
JP H04-23057 U 2/1992
(Continued)

OTHER PUBLICATIONS

International Search Report issued in corresponding International Application No. PCT/JP2017/044589 dated Mar. 6, 2018, with translation (5 pages).
(Continued)

*Primary Examiner* — Edwin A. Leon
*Assistant Examiner* — Iman Malakooti
(74) *Attorney, Agent, or Firm* — Osha Bergman Watanabe & Burton LLP

(57) ABSTRACT

A trigger switch includes a housing including a casing; a trigger coupled to the housing to be capable of approaching and separating from the housing; a contact mechanism including a fixed contact and a movable contact making contact with and separating from the fixed contact in conjunction with approaching and separating operation of the trigger with respect to the housing; a first terminal electrically connected to the contact mechanism; and a second terminal electrically connected to the contact mechanism. The first terminal includes a first fixing portion that connects and fixes the first lead, and a fall-off prevention portion that locks the first lead at a position different from the first fixing portion in an axial direction of the first lead to prevent the axial component from falling off. The second terminal includes a second fixing portion that connects and fixes the second lead.

6 Claims, 6 Drawing Sheets

(51) Int. Cl.
*H01H 13/20* (2006.01)
*H01H 13/04* (2006.01)

(58) Field of Classification Search
USPC ..... 200/341, 522, 332.2, 43.17; 335/78–86, 335/128, 124, 202
See application file for complete search history.

(56) References Cited

FOREIGN PATENT DOCUMENTS

| | | | |
|---|---|---|---|
| JP | H11-162318 | A | 6/1999 |
| JP | 2003-257297 | A | 9/2003 |
| JP | 2015-153626 | A | 8/2015 |

OTHER PUBLICATIONS

Written Opinion of the International Searching Authority issued in corresponding International Application No. PCT/JP2017/044589 dated Mar. 6, 2018, with translation (6 pages).

* cited by examiner

TRIGGER SWITCH

TECHNICAL FIELD

The present disclosure relates to a trigger switch.

BACKGROUND ART

The trigger switch disclosed in PTL 1 includes a housing, a trigger provided to the exterior of the housing and coupled to the housing to be capable of approaching and separating from the housing, a contact mechanism provided in the housing that operates in conjunction with the approaching and separating operation of the trigger with respect to the housing, and a pair of terminals electrically connected to the contact mechanism. The pair of terminals extend from an inside of the housing to an outside of the housing.

CITATION LIST

Patent Literature

PTL 1: JP 2015-153626 A

SUMMARY OF INVENTION

Technical Problem

In recent years, with the reduction in the size and weight of power tools, such as electric screwdrivers, there are increasing cases where space for housing a trigger switch for use in the power tools is limited. For this reason, for example, when providing a diode for absorbing counter electromotive force to the trigger switch, it is possible to fix not to the interior of a housing but to the portions of a pair of terminals located outside of the housing.

When fixing an axial component, such as a diode, to the pair of terminals, generally, a fixing method is used in which each of a pair of leads extending in opposite directions from both sides of the component body is fixed to the corresponding terminal at one place. However, if the above fixing method is used for the trigger switch for use in power tools, such as electric screwdrivers, which generate vibration, the fixing strength decreases due to the generated vibration, and a contact failure may occur between the axial component and the pair of terminals, or the axial component may fall off.

Accordingly, an object of the present disclosure is to provide a trigger switch that can prevent contact failure and falling-off of an axial component fixed outside of the housing.

Solution to Problem

A trigger switch according to an aspect of the present disclosure comprises:

a housing internally including a casing;

a trigger provided to an exterior of the housing and coupled to the housing to be capable of approaching and separating from the housing;

a contact mechanism including a fixed contact provided in the casing and a movable contact provided in the casing to face the fixed contact, the movable contact making contact with and separating from the fixed contact in conjunction with approaching and separating operation of the trigger with respect to the housing;

a first terminal, which has a plate shape, fixed to the housing and electrically connected to the contact mechanism, the first terminal extending from outside the housing to the casing;

a second terminal, which has a plate shape, fixed to the housing and electrically connected to the contact mechanism, the second terminal extending from outside the housing to the casing and including a plate surface facing a plate surface of the first terminal and being disposed in parallel with the first terminal; and an axial component disposed outside of the housing and including a component body, a first lead having a rod shape, and a second lead having a rod shape, the first lead and the second lead extending in opposite directions from each side of the component body and being fixed to the first terminal and the second terminal, respectively, outside of the housing, wherein the first terminal includes a first fixing portion that connects and fixes the first lead, and a fall-off prevention portion that locks the first lead at a position different from the first fixing portion in an axial direction of the first lead to prevent the axial component from falling off, and the second terminal includes a second fixing portion that connects and fixes the second lead.

Advantageous Effects of Invention

In the trigger switch according to the above aspect, the first terminal includes the first fixing portion and the fall-off prevention portion. The first fixing portion connects and fixes the first lead of the axial component. The fall-off prevention portion locks the first lead at a position different from the first fixing portion in the axial direction of the first lead of the axial component to prevent the axial component from falling off. Thus, since the first lead of the axial component is connected and fixed by the first fixing portion and locked by the fall-off prevention portion, it is possible to prevent contact failure and falling-off of the axial component fixed outside of the housing.

DESCRIPTION OF EMBODIMENT

Hereinafter, an embodiment of the present disclosure will be described according to the attached drawings. In the following description, terms that indicate specific directions or positions (for example, terms including "upper", "lower", "right", and "left") are used when necessary, but use of those terms is to facilitate the understanding of the disclosure with reference to the drawings, and the technical scope of the present disclosure is not limited by the meaning of those terms. In addition, the following description is merely illustrative in nature and is not intended to limit the disclosure or the application and uses of the disclosure. Furthermore, the drawings are schematic, and the ratios of dimensions and the like do not necessarily match the actual ones.

Figure 1:
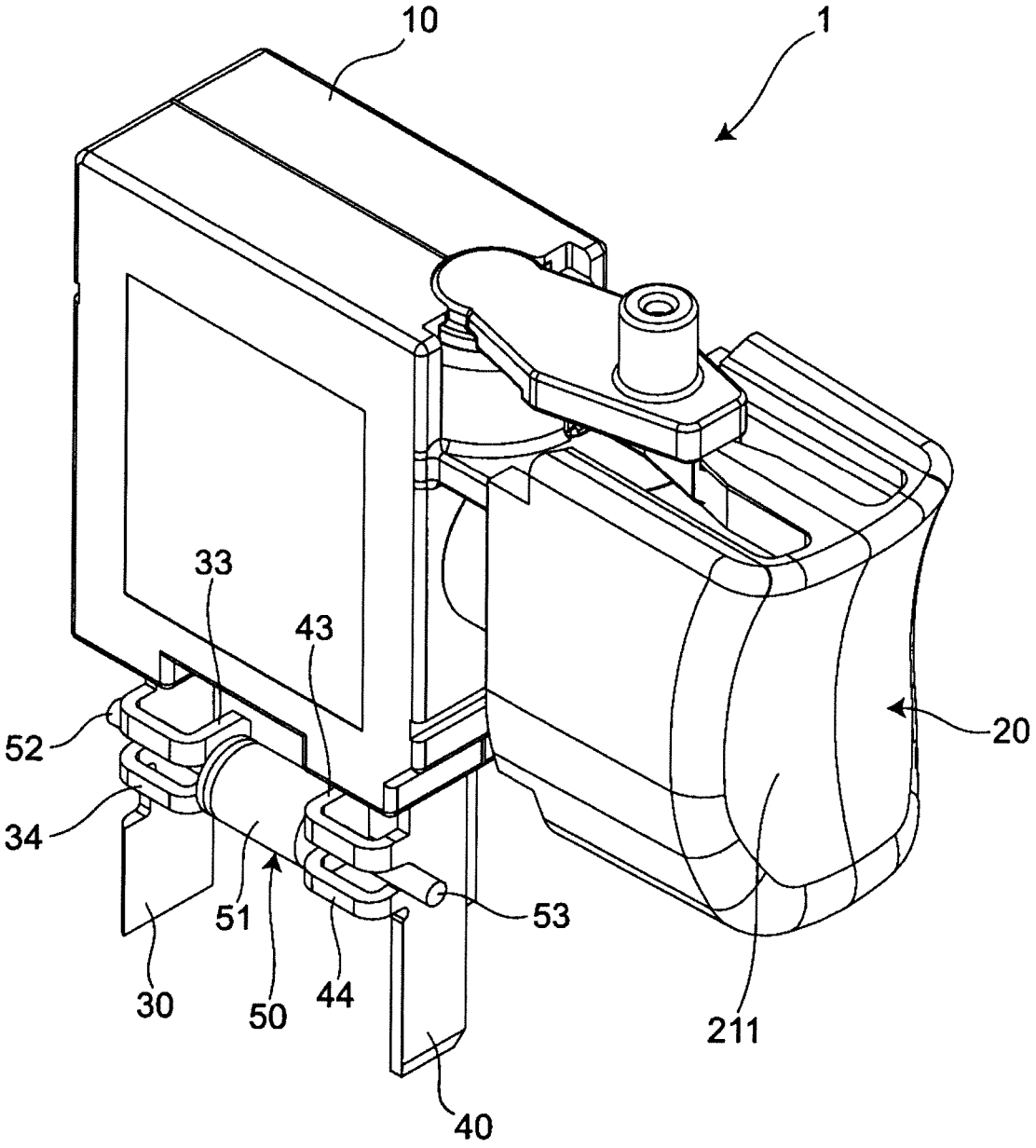
FIG. 1 is a perspective view of a trigger switch according to an embodiment of the present disclosure.
Figure 2:
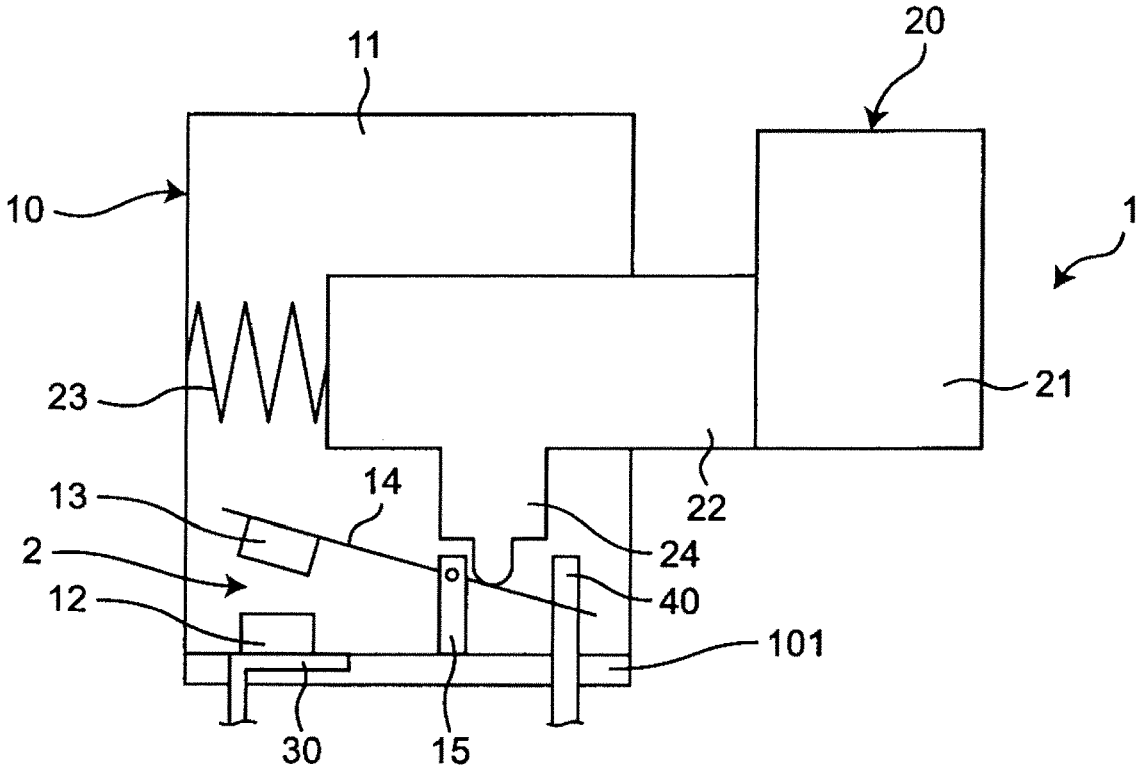
FIG. 2 is a schematic view for explaining the return state of the trigger switch of FIG. 1.
Figure 3:
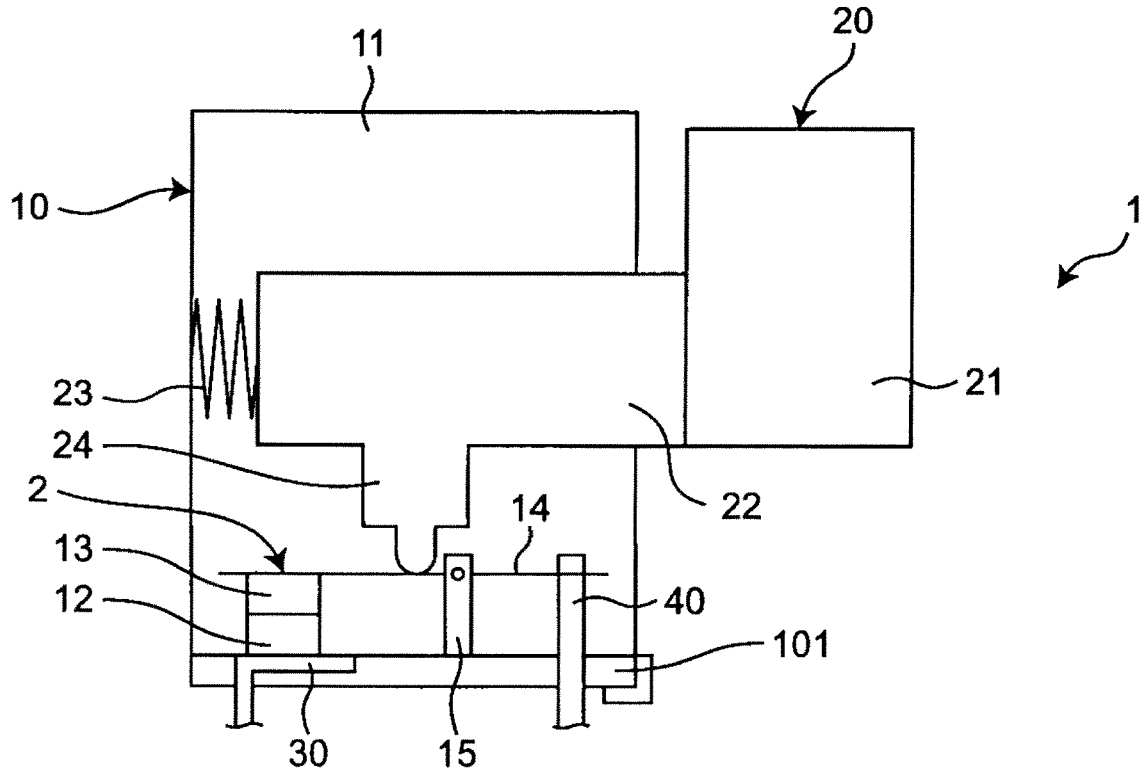
FIG. 3 is a schematic view for explaining the operating state of the trigger switch of FIG. 1.

A trigger switch 1 according to an embodiment of the present disclosure includes, as shown in FIG. 1, an insulating housing 10, an insulating trigger 20, a conductive first terminal 30, a conductive second terminal 40, and an axial component 50. As shown in FIGS. 2 and 3, a casing 11 is provided in the housing 10, and a contact mechanism 2 electrically connected to the first terminal 30 and the second terminal 40 is provided in the casing 11.

The housing 10, as shown in FIG. 1, has a substantially rectangular box shape. The trigger 20 coupled to the housing 10 to be capable of approaching and separating from the housing 10 is disposed on the exterior of the housing 10.

The contact mechanism 2 includes a fixed contact 12 and a movable contact 13 as shown in FIGS. 2 and 3. FIGS. 2 and 3 schematically show the trigger switch 1 with portions of the housing 10 removed. FIG. 2 shows the trigger switch 1 in a return state in which the fixed contact 12 and the movable contact 13 are separated, and FIG. 3 shows the trigger switch 1 in an operating state in which the fixed contact 12 and the movable contact 13 are in contact.

The fixed contact 12 is fixed to the conductive first terminal 30 in the casing 11, and electrically connected to the first terminal 30.

The first terminal 30 has a plate shape and extends from outside the housing 10 to the casing 11. The first terminal 30 is fixed to an end of a wall 101 on a lower side of the housing 10 (i.e., a lower side in the Z direction in FIGS. 2 and 3) away from the trigger 20 as viewed in an approaching and separating direction in which the trigger 20 approaches and separates from the housing 10 (i.e., a left-right direction in FIGS. 2 and 3).

The movable contact 13 is fixed to a movable contact piece 14 in the casing 11, and electrically connected to the conductive second terminal 40 via the movable contact piece 14. The movable contact 13 faces the fixed contact 12, and is disposed to be capable of contact with and separating from the fixed contact 12.

The movable contact piece 14 has a long thin plate shape and extends in the approaching and separating direction of the trigger 20. The movable contact piece 14 is turnably supported by a supporting portion 15 at an intermediate portion of the movable contact piece 14 in a longitudinal direction of the movable contact piece 14. The supporting portion 15 is provided substantially at a center of the wall 101 of the housing 10 in the approaching and separating direction of the trigger 20. The movable contact 13 is fixed to one end (i.e., a left end in FIGS. 2 and 3) of the movable contact piece 14 in the longitudinal direction of the movable contact piece 14. The other end (i.e., a right end in FIGS. 2 and 3) of the movable contact piece 14 in the longitudinal direction of the movable contact 13 is in contact with the second terminal 40.

The second terminal 40 has a plate shape and extends from outside the housing 10 to the casing 11. The second terminal 40 is fixed to an end of the wall 101 on the lower side of the housing 10 toward the trigger 20 in the approaching and separating direction of the trigger 20, and is electrically independent of the first terminal 30. The second terminal 40, with a plate surface facing a plate surface of the first terminal 30, is disposed in parallel with the first terminal 30.

As shown in FIGS. 2 and 3, the trigger 20 includes an operation body 21 and an operation shaft 22. The operation body 21 is disposed on one side in the short-side direction of the housing 10 (i.e., the left-right direction in FIGS. 2 and 3) and operated by a user with a finger. The operation shaft 22 extends from the surface of the operation body 21 facing the housing 10 toward the housing 10 to the interior of the housing 10.

The operation body 21 includes a curved surface 211 (shown in FIG. 1) provided on the surface away from the housing 10 in the approaching and separating direction of the trigger 20 so that the operation body 21 is easily operated by the finger of the user.

As shown in FIGS. 2 and 3, the operation shaft 22 has one end in an extending direction of the operation shaft 22 (i.e., the left-right direction in FIGS. 2 and 3) coupled to the operation body 21 outside of the housing 10, and the other end in the extending direction of operation shaft 22 being coupled to the housing 10 to be movable in the casing 11 of the housing 10. A return spring 23, which biases the operation shaft 22 in a direction in which the trigger 20 separates from the housing 10, is provided to the other end of the operation shaft 22 in the extending direction of the operation shaft 22.

A plunger 24, which extends from the operation shaft 22 in the casing 11 toward the wall 101 of the housing 10, is provided to the operation shaft 22. The plunger 24 is disposed such that the leading end thereof (i.e., the lower end in FIGS. 2 and 3) can make contact with the movable contact piece 14 in conjunction with the movement of the trigger 20.

That is, the movable contact 13 makes contact with and separates from the fixed contact 12 in conjunction with the approaching and separating operation of the trigger 20 as follows.

When the trigger 20 is moved toward the housing 10 by operating the operation body 21 of the trigger 20 of the trigger switch 1 in the return state shown in FIG. 2, the trigger 20 approaching the housing 10, the plunger 24 makes contact with the movable contact piece 14 further toward the first terminal 30 side than the supporting portion 15 in conjunction with the movement of the trigger 20 in a direction approaching the housing 10 (i.e., the approaching operation) and turns the movable contact piece 14 in a counterclockwise direction in a plan view taken along a direction of the rotation axis of the movable contact piece (i.e., a direction penetrating the drawing sheet of FIG. 2 and FIG. 3). Thus, the movable contact 13 is brought close to the wall 101 on the lower side of the housing 10 into contact with the fixed contact 12, resulting in the operating state shown in FIG. 3.

When the finger is released from the operation body 21 of the trigger 20 of the trigger switch 1 in the operating state shown in FIG. 3, the return spring 23 biases the operation shaft 22 in the direction in which the trigger 20 separates from the housing 10, to move the trigger 20 in the direction in which the trigger 20 separates from the housing 10. The plunger 24 makes contact with the movable contact piece 14 further toward the second terminal 40 side than the supporting portion 15 in conjunction with the movement (i.e., the separating operation) of the trigger 20 in a direction separating from the housing 10 and turns the movable contact piece 14 in a clockwise direction in a plan view taken along a direction of the rotation axis of the movable contact piece 14. Thus, the movable contact 13 moves away from the wall 101 on the lower side of the housing 10 and separates from the fixed contact 12, resulting in the return state shown in FIG. 2.

An axial component 50 is, for example, a diode or capacitor, and as shown in FIG. 1, includes a component body 51 having a cylindrical shape. The first lead 52 and second lead 53 having cylindrical rod shapes which extend in opposite directions from each side in the axial direction of the component body 51. The axial component 50 is disposed outside of the housing 10. The first lead 52 is fixed to the first terminal 30 outside of the housing 10, and the second lead 53 is fixed to the second terminal 40 outside of the housing 10.

Figure 4:
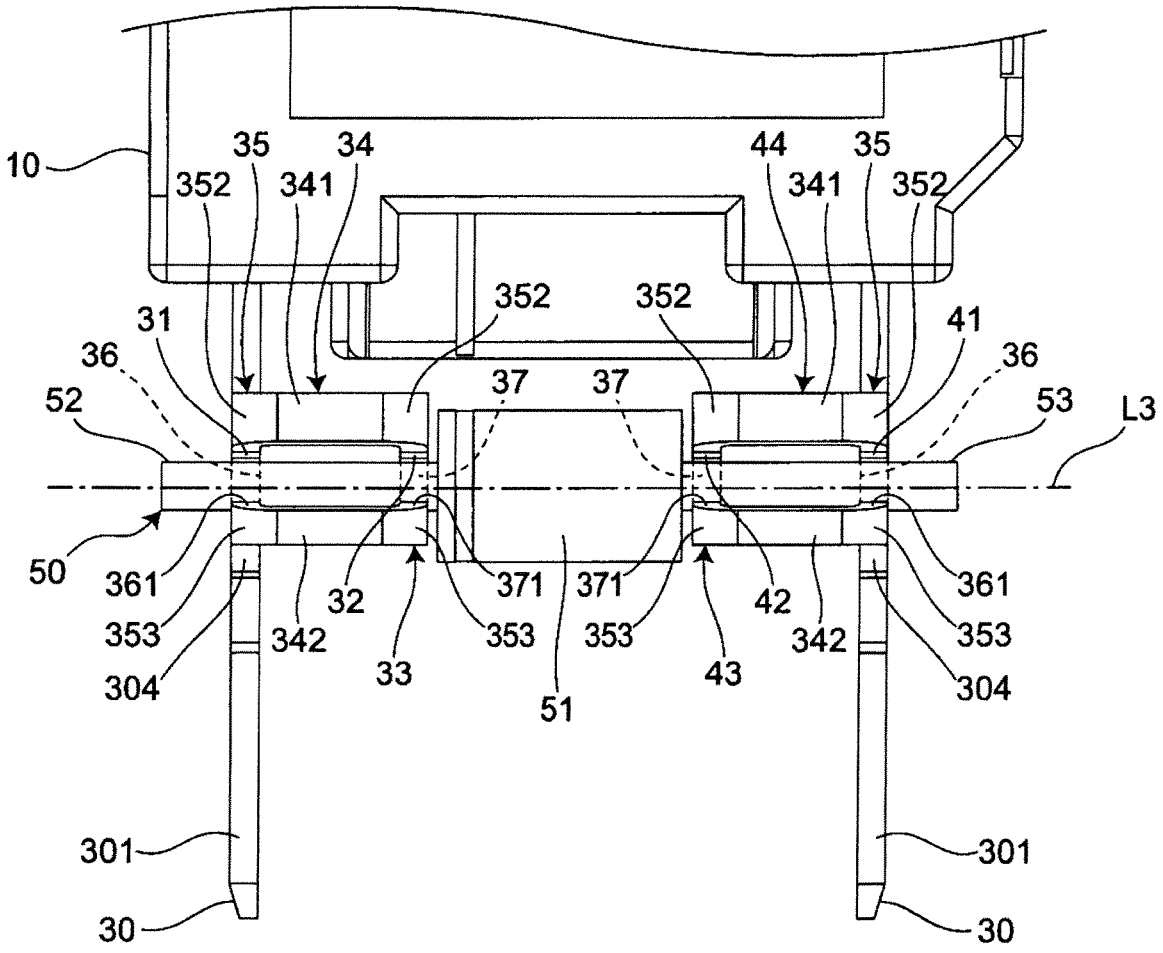
FIG. 4 is a plan view showing the periphery of an axial component of the trigger switch of FIG. 1.
Figure 5:
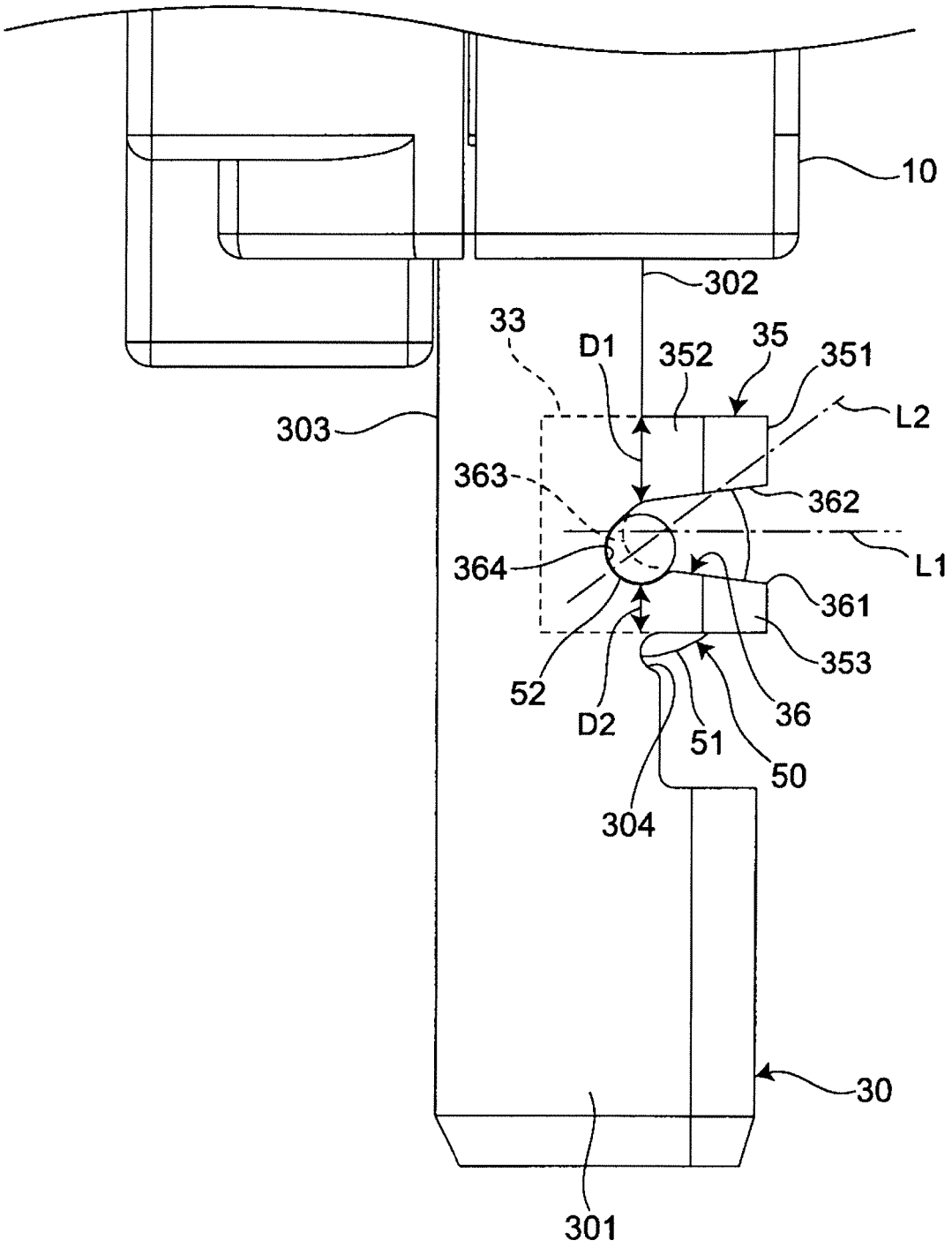
FIG. 5 is a side view showing the periphery of the axial component of the trigger switch of FIG. 1.

Next, the first terminal 30, the second terminal 40, and the axial component 50 will be described in more detail with reference to FIG. 1, FIG. 4, and FIG. 5. FIG. 1, FIG. 4, and FIG. 5 show the state before the first lead 52 of the axial component 50 is fixed to the first terminal 30 and the second lead 53 of the axial component 50 is fixed to the second terminal 40.

As shown in FIG. 4, the first terminal 30 includes a first fixing portion 31 that fixes the first lead 52 of the axial component 50 and a first fall-off prevention portion 32 that locks the first lead 52 at a position different from the first fixing portion 31 in the axial direction of the first lead 52. The second terminal 40 includes a second fixing portion 41 that fixes the second lead 53 of the axial component 50 and a second fall-off prevention portion 42 that locks the second lead 53 at a position different from the second fixing portion 41 in the axial direction of the second lead 53.

Specifically, as shown in FIGS. 1 and 4, the first terminal 30 includes a first terminal body 301, a first plate member 33, and a first connection member 34 that connects the first terminal body 301 and the first plate member 33. The first terminal body 301 extends substantially perpendicularly to the wall 101 on the lower side of the housing 10. The first plate member 33 includes a plate surface facing a plate surface of the first terminal 30. The first plate member 33 is disposed in parallel with the first terminal 30 in a direction toward the second terminal 40 in the axial direction of the first lead 52.

As shown in FIG. 5, the first terminal body 301 includes a protrusion 35 having a rectangular shape and a first recess 36 constituting the first fixing portion 31.

The protrusion 35 has a rectangular shape in a plane intersecting the axial direction of the first lead 52. The protrusion 35 protrudes in a plate width direction of the first terminal body 301 from a first side surface 302. The first side surface 302 is one of a pair of first and second side surfaces 302, 303 of the first terminal body 301 facing each other in the plate width direction of the first terminal body 301 (i.e., the left-right direction in FIG. 5). The plate width direction of the first terminal body 301 intersects an extending direction of the first terminal body 301 (i.e., the vertical direction in FIG. 5) and the axial direction of the first lead 52 (i.e., the direction penetrating the drawing sheet of FIG. 5).

The first recess 36 includes an opening 361, a recess body 362, and a positioning notch 364. The opening 361 is provided in an end 351 of the protrusion 35 away from the first side surface 302 of the first terminal body 301 in the plate width direction of the first terminal body 301. The recess body 362 is connected to the opening 361. The positioning notch 364 is connected to the recess body 362.

The opening 361 is disposed at a position further away from the housing 10 than a center of the end 351 of the protrusion 35 in an extending direction of the first terminal body 301. Comparing the thicknesses D1, D2 in the extending direction of the first terminal body 301 of the bases of a first wall 352 and second wall 353 which are located on each side of the first recess 36 in the extending direction of the first terminal body 301, the thickness D1 of the first wall 352 closer to the housing 10 (i.e., the upper side in FIG. 5) is greater than the thickness D2 of the second wall 353 away from the housing 10 (i.e., the lower side in FIG. 5).

The recess body 362 extends in a tapered shape along a first line L1 extending from the opening 361 in the extending direction of the first terminal body 301.

The positioning notch 364 has an arc shape curved along the outer shape (i.e., circular) in the axial direction of the first lead 52. The positioning notch 364 extends along a second line L2 intersecting the first line L1 from a bottom 363 of the recess body 362 facing the opening 361. That is, the positioning notch 364 extends, from the bottom 363 of the recess body 362, in a direction away from the housing 10 in the extending direction of the first terminal body 301 and away from the second wall 353 of the protrusion 35 in the plate width direction of the first terminal body 301.

The first lead 52 of the axial component 50 is fixed in the first recess 36 as follows. As shown in FIG. 5, with the axis oriented in the direction intersecting the plate surface of the first terminal body 301, the first lead 52 is inserted into the first recess 36 and disposed in the positioning notch 364. Then, while the first lead 52 is positioned by the positioning notch 364, the second wall 353 of the protrusion 35 is bent toward the first wall 352 so that the first lead 52 is held by the first wall 352 and the second wall 353. Thus, the first lead 52 is connected and fixed to the first recess 36.

A groove 304 adjacent to the second wall 353 is provided in the first side surface 302 of the first terminal body 301. This allows the second wall 353 to be easily bent toward the first wall 352.

As shown in FIG. 4, the first plate member 33 includes a second recess 37 constituting the first fall-off prevention portion 32.

The second recess 37 includes an opening 371 at one end of the first terminal body 301 in the plate width direction of the first terminal body 301. The second recess 37 is disposed on the same side as the first recess 36 in the extending direction of the first terminal body 301 (i.e., the vertical direction in FIG. 4) in a plane intersecting the first lead 52. The second recess 37 is disposed on a third line L3 that passes through a center of the first recess 36 in the extending direction of the first terminal body 301 and that extends in a direction substantially orthogonal to the extending direction of the first terminal body 301. The second recess 37 has the same configuration as the first recess 36. Therefore, as for the second recess 37, the same reference numbers as those of the first recess 36 are given to portions corresponding to the first recess 36, and the description of the first recess 36 is applied.

That is, the first lead 52 of the axial component 50 is held in the second recess 37 at a position different from the first recess 36. Thus, the first lead 52 is locked in the second recess 37.

As shown in FIG. 4, the first connection member 34 includes a first member 341 and a connection member 342. The first member 341 extends in a thickness direction of the first terminal body 301 (i.e., the left-right direction in FIG. 4) and connects the first wall 352 of the protrusion 35 of the first terminal body 301 and the first wall portion 352 of the first plate member 33. The connection member 342 extends substantially parallel to the first member 341 and connects the second wall 353 of the protrusion 35 of the first terminal body 301 and the second wall 353 of the first plate member.

Provided between the first member 341 and the second member 342 is a gap into which the first lead 52 can be inserted.

In this embodiment, the first terminal body 301, the first plate member 33, and the first connection member 34 are integrally formed from a single conductive metal sheet.

The second terminal 40, as shown in FIGS. 1 and 4, includes a second terminal body 401, a second plate member 43, and a second connection member 44 that connects the second terminal 40 and the second plate member 43. The second terminal body 401 extends substantially perpendicularly to the wall 101 on the lower side of the housing 10. The second plate member 43 includes a plate surface facing a plate surface of the second terminal 40, and is disposed in parallel with the second terminal 40 in a direction toward the first terminal 30 in an axial direction of the second lead 53.

The second terminal body 401, second plate member 43, and second connection member 44 of the second terminal 40 have the same configuration as the first terminal body 301, first plate member 33, and first connection member 34 of the first terminal 30, respectively. Therefore, as for the second terminal 40, the same reference numbers as those of the first terminal 30 are given to portions corresponding to the first terminal 30, and the description of the first terminal 30 is applied.

As shown in FIG. 4, the axial component 50 is disposed such that the first lead 52 is substantially orthogonal to the plate surface of the first terminal 30 and the plate surface of the plate member 33, and the second lead 53 is substantially orthogonal to the plate surface of the second terminal 40 and the plate surface of the plate member 43. The first lead 52 is connected and fixed by the first recess 36 constituting the first fixing portion 31 of the first terminal 30, and is locked by the second recess 37 constituting the first fall-off prevention portion 32. The second lead 53 is connected and fixed by the first recess 36 constituting the first fixing portion 41 of the second terminal 40, and is locked by the second recess 37 constituting the second fall-off prevention portion 42.

As described above, in the trigger switch 1, the first terminal 30 includes the first fixing portion 31 and the first fall-off prevention portion 32. The first fixing portion 31 connects and fixes the first lead 52 of the axial component 50. The first fall-off prevention portion 32 locks the first lead 52 at the position different from the first fixing portion 31 in the axial direction of the first lead 52 of the axial component 50 to prevent the axial component 50 from falling off. Thus, since the first lead 52 of the axial component 50 is connected and fixed by the first fixing portion 31 and locked by the first fall-off prevention portion 32, it is possible to prevent contact failure and falling-off of the axial component fixed outside of the housing 10.

Since the second terminal 40 includes the second fixing portion 41 and the second fall-off prevention portion 42, the second lead 53 of the axial component 50 is also connected and fixed by the second fixing portion 41 and locked by the second fall-off prevention portion 42. Thus, it is possible to more reliably prevent contact failure and falling-off of the axial component fixed outside of the housing 10.

The first terminal 30 includes the first terminal body 301, the first plate member 33, and the first connection member 34. This enables the first lead 52 of the axial component 50 to be connected and fixed by the first fixing portion 31 and locked by the first fall-off prevention portion 32 with a simple configuration.

The first plate member 33 includes the plate surface facing the plate surface of the terminal body 301, and is disposed in parallel with the terminal body 301 in the direction toward the second terminal 40 in the axial direction of the first lead 30. The second plate member 43 includes the plate surface facing the plate surface of the terminal body 301, and is disposed in parallel with the terminal body 301 in the direction toward the first terminal in the axial direction of the second lead 53. This facilitates the positioning of the axial component 50.

The first recess 36 constituting the first fixing portion 31 and the second recess constituting the first fall-off prevention portion 32 have the recess body 362 and the positioning notch 364. This enables the first lead 52 to be fixed while being positioned by the positioning notch 364, and thus the first lead 52 can be more firmly fixed by the first fixing portion 312 and more firmly locked by the first fall-off prevention portion 32.

In the above embodiment, the first recess 36 constitutes the first fixing portion 31 and the second fixing portion, and the second recess 37 constitutes the first fall-off prevention portion 32 and the second fall-off prevention portion 42, but the present disclosure is not limited to the above embodiment. One of the first recess 36 and the second recess 37 may constitute the first fall-off prevention portion 32 and the second fall-off prevention portion 42, and the other recess may constitute the first fixing portion 31 and the second fixing portion.

The fall-off prevention portion may be provided to only one of the first terminal 30 and the second terminal 40.

The fixing portion and the fall-off prevention portion are not limited to being configured from the first recess 36 and the second recess 37. The fixing portion and the fall-off prevention portion may be provided at a plurality of different positions in the axial direction of the lead of the axial component, as long as it is possible to connect and fix the lead of the axial component and prevent falling-off of the axial component. Other fixing or locking structures may be employed.

Figure 6:
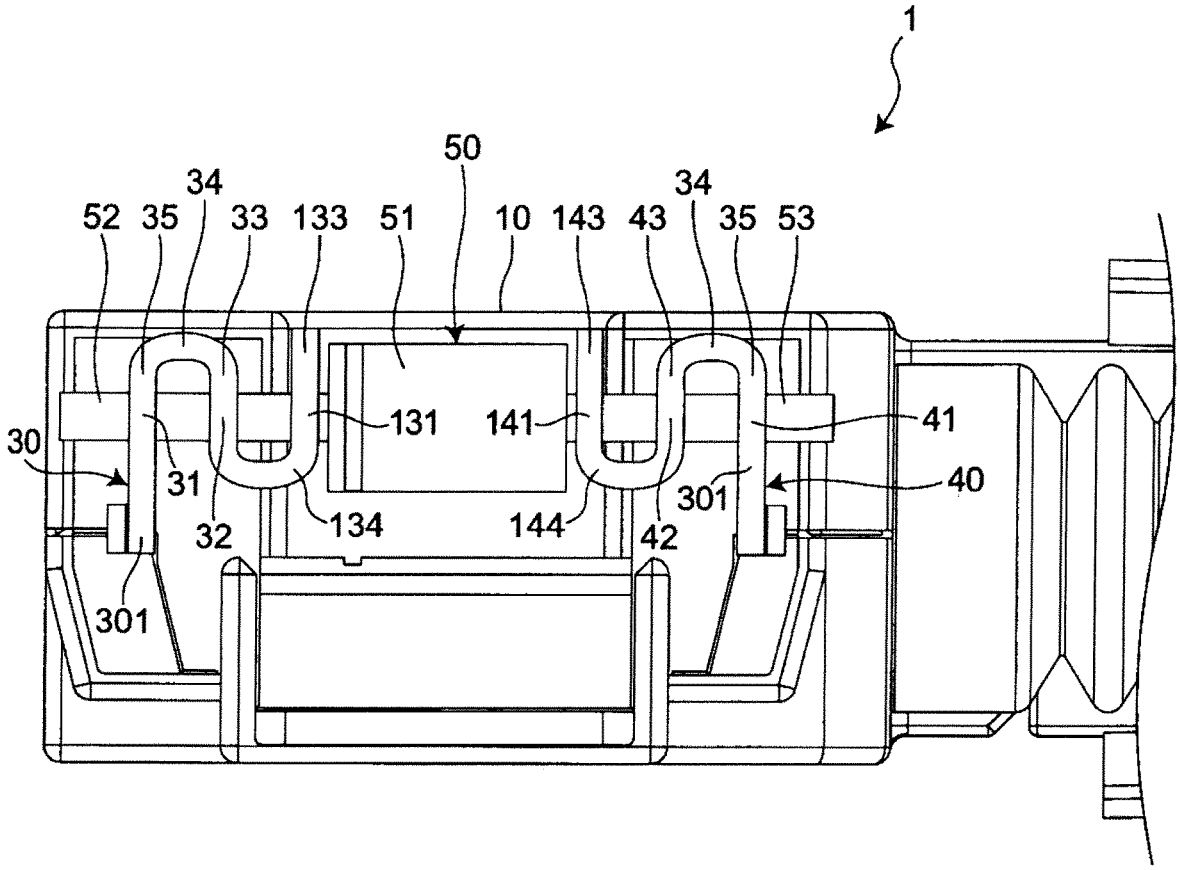
FIG. 6 is a bottom view showing a first modification of the trigger switch of FIG. 1.

For example, as shown in FIG. 6, a third fixing portion or fall-off prevention portions 131, 141 may be provided at three positions of the first lead 52 and the second lead 53 in the axial direction. In this case, there may be provided a third plate member 133, a third connection member 134, a fourth plate member 143, and a fourth connection member 144. The third plate member 133 includes a plate surface facing the plate surface of the first plate member 33, and is disposed in parallel with the first plate member 33 in the direction toward the second terminal 40 in the axial direction of the first lead 52. The third connection member 134 connects the first plate member 33 and the third plate member 133. The fourth plate member 143 includes a plate surface facing the plate surface of the second plate member 43, and is disposed in parallel with the second plate member 43 in the direction toward the first terminal 30 in the axial direction of the second lead 53. The fourth connection member 144 connects the second plate member 43 and the fourth plate member 143. The same configuration as the first plate member 33 may be used for the third plate member 133 and the fourth plate member 143, and the same configuration as the first connection member 34 may be used for the third connection member 134 and the fourth connection member 144.

Figure 7:
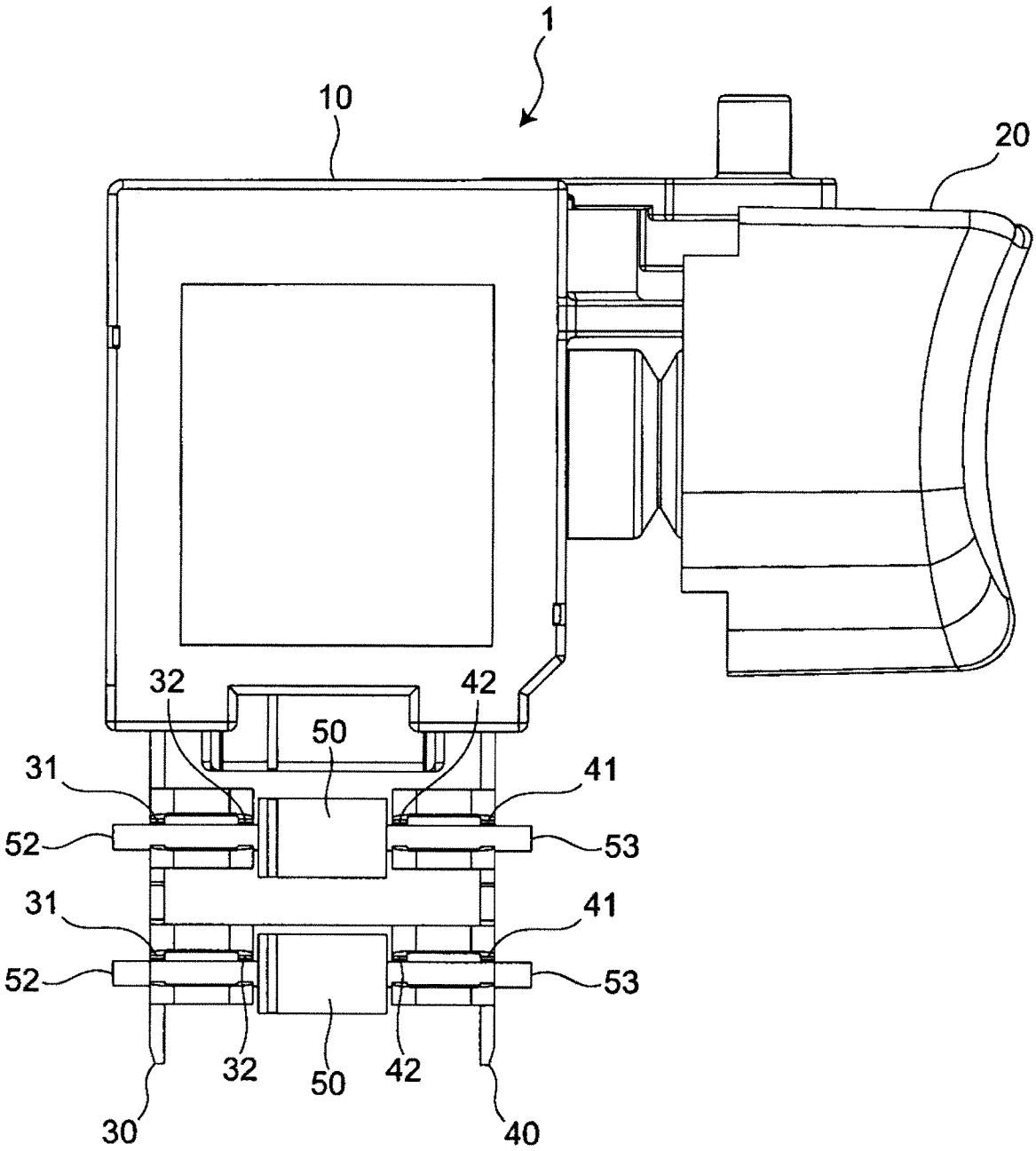
FIG. 7 is a plan view showing a second modification of the trigger switch of FIG. 1.

The number of axial components 50 is not limited to one, and a plurality of axial components may be provided as shown in FIG. 7. In this case, all of the plurality of axial components 50 may be locked while connected and fixed by the fixing portions and fall-off prevention portions of the same configuration, or may be locked while connected and fixed by the fixing portions and fall-off prevention portions of configurations that vary with the axial components 50.

While the various embodiments of the present disclosure have been described in detail with reference to the drawings, various aspects of the present disclosure will be finally described. In the following description, as an example, reference signs will also be used.

A trigger switch 1 according to a first aspect of the present disclosure comprises:

a housing 10 internally including a casing 11;

a trigger 20 provided to an exterior of the housing 10 and coupled to the housing 10 to be capable of approaching and separating from the housing 10;

a contact mechanism 2 including a fixed contact 12 provided in the casing 11 and a movable contact 13 provided in the casing 11 to face the fixed contact 12, the movable contact 13 making contact with and separating from the fixed contact 12 in conjunction with approaching and separating operation of the trigger 20 with respect to the housing 10;

a first terminal 30, which has a plate shape, fixed to the housing 10 and electrically connected to the contact mechanism 2, the first terminal 30 extending from outside the housing 10 to the casing 11;

a second terminal 40, which has a plate shape, fixed to the housing 10 and electrically connected to the contact mechanism 2, the second terminal 40 extending from outside the housing 10 to the casing 11 and including a plate surface facing a plate surface of the first terminal 30 and being disposed in parallel with the first terminal 30; and an axial component 50 disposed outside of the housing 10 and including a component body 51, a first lead 52 having a rod shape, and a second lead 53 having a rod shape, the first lead 52 and the second lead 53 extending in opposite directions from each side of the component body 51 and being fixed to the first terminal 30 and the second terminal 40, respectively, outside of the housing 10, wherein the first terminal 30 includes a first fixing portion 31 that connects and fixes the first lead 52, and a fall-off prevention portion 32 that locks the first lead 52 at a position different from the first fixing portion 31 in an axial direction of the first lead 52 to prevent the axial component 50 from falling off, and the second terminal 40 includes a second fixing portion 41 that connects and fixes the second lead 53.

With the trigger switch 1 according to the first aspect, the first lead 52 of the axial component 50 is connected and fixed by the first fixing portion 31 and locked by the first fall-off prevention portion 32. Thus, it is possible to prevent contact failure and falling-off of the axial component 50 fixed outside of the housing 10.

In the trigger switch 1 according to a second aspect of the present disclosure, wherein the fall-off prevention portion 32 of the first terminal 30 is a first fall-off prevention portion 32, and the second terminal 40 includes a second fall-off prevention portion 42 that locks the second lead 53 to prevent the axial component 50 from falling off.

With the trigger switch 1 according to the second aspect, the second lead 53 of the axial component 50 is also connected and fixed by the second fixing portion 41 and locked by the second fall-off prevention portion 42. Thus, it is possible to more reliably prevent contact failure and falling-off of the axial component 50 fixed outside of the housing 10.

In the trigger switch 1 according to a third aspect of the present disclosure, wherein the first terminal 30 includes:

a terminal body 301 extending from outside the housing 10 to the casing 11;

a plate member 33 including a plate surface facing a plate surface of the terminal body 301, the plate member 33 being disposed in parallel with the terminal body 301 in a direction toward the second terminal 40 in the axial direction of the first lead 52; and a connection member 34 connecting the terminal body 301 and the plate member 33, wherein the first fixing portion 31 is provided to the terminal body 301 and the second fixing portion 41 is provided to the plate member 33, or the first fixing portion 31 is provided to the plate member 33 and the second fixing portion 41 is provided to the terminal body 301.

The trigger switch 1 according to the third aspect enables the first lead 52 of the axial component 50 to be connected and fixed by the first fixing portion 31 and locked by the first fall-off prevention portion 32 with a simple configuration. Further, the plate member 33 includes the plate surface facing the plate surface of the terminal body 301, and is disposed in parallel with the terminal body 301 in a direction toward the second terminal 40 in the axial direction of the first lead 52, thereby facilitating the positioning of the axial component 50.

In the trigger switch 1 according to a fourth aspect of the present disclosure, wherein the terminal body 301 includes:

a protrusion 35 protruding in a plate width direction, which intersects an extending direction of the terminal body 301 and the axial direction of the first lead 52, from one of a pair of side surfaces 302, 303 of the terminal body 301 facing each other in the plate width direction; and a first recess 36 including an opening 361 at an end of the protrusion 35 away from the side surface 302 in the plate width direction, the plate member 33 includes:

a second recess 37 including an opening 371 at an end in the plate width direction, the second recess 37 being disposed on a same side as the first recess 36 in an extending direction of the first terminal body 301 in a plane intersecting the first lead 52, the first recess 36 and the second recess 37 each includes:

a recess body 362 that is connected to the opening 361, 371 and extends along a first line L1 extending from the opening 361, 371 to the side surface 302; and a positioning notch 364 that is connected to the recess body 362 and extends along a second line L2 intersecting the first line L1 from a bottom 363 of the recess body 362 facing the opening 361, 371, and the first recess 36 is the first fixing portion 31 and the second recess 37 is the second fixing portion 41, or the second recess 37 is the first fixing portion 31 and the first recess 36 is the second fixing portion 41.

The trigger switch 1 according to the fourth aspect enables the first lead 52 to be fixed while being positioned by the positioning notch 364. Thus, the first lead 52 can be more firmly fixed by the first fixing portion 31 and firmly locked by the first fall-off prevention portion 32.

It should be understood that advantageous effects may be obtained by combining, as appropriate, any of the above various embodiment(s) or modification(s). Further, any combination of the embodiments, combination of the examples, or combination of both are possible, and any combination of features in different embodiments or examples are also possible.

While the present disclosure has been fully described in connection with the preferred embodiment with reference to the accompanying drawings, various changes and modifications will be apparent to those skilled in the art. Such changes and modifications are to be understood as included within the scope of the present disclosure as set forth in the appended claims, unless they depart therefrom.

INDUSTRIAL APPLICABILITY

The trigger switch of the present disclosure can be applied to power tools such as electric screwdrivers.

REFERENCE SIGNS LIST

1. trigger switch
2. contact mechanism
10. housing
101. wall
11. casing
12. fixed contact
13. movable contact
14. movable contact piece
15. supporting portion
20. trigger
21. operation body
211. curved surface
22. operation shaft
23. return spring
24. plunger
30. first terminal
301. first terminal body
302. first side surface
303. second side surface
304. groove
31. first fixing portion
32. first fall-off prevention portion
33. first plate member
34. first connection member
35. protrusion
351. end
352. first wall
353. second wall
36. first recess
361. opening
362. recess body
363. bottom
364. positioning notch
37. second recess
371. opening
40. second terminal
401. second terminal body
41. second fixing portion
42. second fall-off prevention portion
43. second plate member
44. second connection member
131. fixing portion
133. third plate member
141. fall-off prevention portion
143. fourth plate member
50. axial component
51. component body
52. first lead
53. second lead
D1, D2. thickness
L1, L2, L3. line

The invention claimed is:

1. A trigger switch comprising:

a housing internally including a casing;

a trigger provided to an exterior of the housing and coupled to the housing to be capable of approaching and separating from the housing;

a contact mechanism including a fixed contact provided in the casing and a movable contact provided in the casing to face the fixed contact, the movable contact making contact with and separating from the fixed contact in conjunction with approaching and separating operation of the trigger with respect to the housing;

a first terminal, which has a plate shape, fixed to the housing and electrically connected to the contact mechanism, the first terminal extending from outside the housing to the casing;

a second terminal, which has a plate shape, fixed to the housing and electrically connected to the contact mechanism, the second terminal extending from outside the housing to the casing and including a plate surface facing a plate surface of the first terminal and being disposed in parallel with the first terminal; and an axial component disposed outside of the housing and including a component body, a first lead having a rod shape, and a second lead having a rod shape, the first lead and the second lead extending in opposite directions from each side of the component body and being fixed to the first terminal and the second terminal, respectively, outside of the housing, wherein the first terminal includes a first fixing portion that connects and fixes the first lead, and a fall-off prevention portion that locks the first lead at a position different from the first fixing portion in an axial direction of the first lead to prevent the axial component from falling off, and the second terminal includes a second fixing portion that connects and fixes the second lead.

2. The trigger switch according to claim 1, wherein the fall-off prevention portion of the first terminal is a first fall-off prevention portion, and the second terminal includes a second fall-off prevention portion that locks the second lead to prevent the axial component from falling off.

3. The trigger switch according to claim 1, wherein the first terminal includes:

a terminal body extending from outside the housing to the casing;

a plate member including a plate surface facing a plate surface of the terminal body, the plate member being disposed in parallel with the terminal body in a direction toward the second terminal in the axial direction of the first lead; and a connection member connecting the terminal body and the plate member, wherein the first fixing portion is provided to the terminal body and the fall-off prevention portion is provided to the plate member, or the first fixing portion is provided to the plate member and the fall-off prevention portion is provided to the terminal body.

4. The trigger switch according to claim 3, wherein the terminal body includes:

a protrusion protruding in a plate width direction, which intersects an extending direction of the terminal body and the axial direction of the first lead, from one of a pair of side surfaces of the terminal body facing each other in the plate width direction; and a first recess including an opening at an end of the protrusion away from the side surface in the plate width direction, the plate member includes:

a second recess including an opening at an end in the plate width direction, the second recess being disposed on a same side as the first recess in an extending direction of the first terminal body in a plane intersecting the first lead, the first recess and the second recess each include:

a recess body that is connected to the opening and extends along a first line extending from the opening to the side surface; and a positioning notch that is connected to the recess body and extends along a second line intersecting the first line from a bottom of the recess body facing the opening, and the first recess is the first fixing portion and the second recess is the fall-off prevention portion, or the second recess is the first fixing portion and the first recess is the fall-off prevention portion.

5. The trigger switch according to claim 2, wherein the first terminal includes:

a terminal body extending from outside the housing to the casing;

a plate member including a plate surface facing a plate surface of the terminal body, the plate member being disposed in parallel with the terminal body in a direction toward the second terminal in the axial direction of the first lead; and a connection member connecting the terminal body and the plate member, wherein the first fixing portion is provided to the terminal body and the fall-off prevention portion is provided to the plate member, or the first fixing portion is provided to the plate member and the fall-off prevention portion is provided to the terminal body.

6. The trigger switch according to claim 5, wherein the terminal body includes:

a protrusion protruding in a plate width direction, which intersects an extending direction of the terminal body and the axial direction of the first lead, from one of a pair of side surfaces of the terminal body facing each other in the plate width direction; and a first recess including an opening at an end of the protrusion away from the side surface in the plate width direction, the plate member includes:

a second recess including an opening at an end in the plate width direction, the second recess being disposed on a same side as the first recess in an extending direction of the first terminal body in a plane intersecting the first lead, the first recess and the second recess each include:

a recess body that is connected to the opening and extends along a first line extending from the opening to the side surface; and a positioning notch that is connected to the recess body and extends along a second line intersecting the first line from a bottom of the recess body facing the opening, and the first recess is the first fixing portion and the second recess is the fall-off prevention portion, or the second recess is the first fixing portion and the first recess is the fall-off prevention portion.

* * * * *